US007914281B2

(12) United States Patent
Tsai

(10) Patent No.: US 7,914,281 B2
(45) Date of Patent: Mar. 29, 2011

(54) GAS COMBUSTION APPARATUS AND COMBUSTION GAS SETTING DEVICE THEREOF

(76) Inventor: Chih-Lin Tsai, San Chung (TW)

( * ) Notice: Subject to any disclaimer, the term of this patent is extended or adjusted under 35 U.S.C. 154(b) by 381 days.

(21) Appl. No.: 12/264,455

(22) Filed: Nov. 4, 2008

(65) Prior Publication Data

US 2010/0112501 A1 May 6, 2010

(51) Int. Cl.
*B23K 3/02* (2006.01)
*F23D 14/62* (2006.01)

(52) U.S. Cl. ..... 431/153; 431/344; 431/255; 431/277; 431/345

(58) Field of Classification Search ..... 431/153, 431/344, 345, 255
See application file for complete search history.

(56) References Cited

U.S. PATENT DOCUMENTS 5,771,880 A * 6/1998 Tsai ..... 126/414
5,803,061 A * 9/1998 Kao ..... 126/414
5,816,794 A * 10/1998 Tsai ..... 431/344
6,874,671 B2 * 4/2005 Hirano et al. ..... 228/51
7,527,496 B2 * 5/2009 Lin ..... 431/344
2008/0057455 A1 * 3/2008 Tsai ..... 431/153
* cited by examiner

*Primary Examiner* — Steven B McAllister
*Assistant Examiner* — Nikhil Mashruwala
(74) *Attorney, Agent, or Firm* — Guice Patents PLLC

(57) ABSTRACT

The present invention relates to a gas combustion apparatus, composed by a storage tank, a combustion gas setting device, an ignition device, a housing, a combustion device and an outer tube. When the pushing rod of the adjusting unit is forwardly pushed from the bottom end of the vertical slot of the adjusting slot and is rotated into the horizontal slot, the first resilient member is compressed and the gas discharging nozzle is stretched by the adjusting unit, and the gas discharging valve gate is rotated in the gas adjusting valve seat, so a combustion gas supplying status is obtained and the output amount of combustion gas can be adjusted; when the pushing rod of the adjusting unit is forwardly pushed to the top end from the bottom end of the vertical slot of the adjusting slot, the first resilient member is compressed and the gas discharging nozzle is stretched by the adjusting unit, so the adjusting unit is released from the gas discharging valve gate, then the setting unit is rotated and the gas discharging valve gate is rotated in the gas adjusting valve seat, therefore the output amount of combustion gas of the gas discharging valve is able to be reset.

17 Claims, 8 Drawing Sheets

GAS COMBUSTION APPARATUS AND COMBUSTION GAS SETTING DEVICE THEREOF

BACKGROUND OF THE INVENTION

1. Field of the Invention

The present invention relates to a gas combustion apparatus, more particularly to a gas combustion apparatus having combustion gas setting device, the combustion gas setting device is not only able to control the transportation and the output amount of the combustion gas, but also to reset the output amount of the combustion gas of the gas discharging valve, so the pressure differences inside the storage tank due to different operating locations can be accommodated.

2. Description of Related Art

Fire is a must-have matter in human being's daily life, with fire we can cook food, have lights, even operating casting, melting or welding metals. Take a gas combustion apparatus, a refillable lighter or a portable gas stove, for instance, liquefied gas is adopted so operations of ignition and cooking can be processed. So far, the gas combustion apparatus still has a role that is hard to be replaced.

A combustion gas control device is one of the important units for a gas combustion apparatus, and has functions of transportation of combustion gas, continuous supply of combustion gas and adjusting output amount of combustion gas. A conventional combustion gas control device of a gas combustion apparatus is illustrated with the Taiwan Patent No. M306647, corresponding to the U.S. patent application Ser. No. 11/590,911, filed by the applicant of the present invention, when a sliding member is pressed and downwardly moved, an active member provided at one end of the sliding member is driven to push a passive sheet of a swing member, so a connecting sheet provided at the other end of the passive sheet is raised, so a gas discharging valve fastened on a top end of a storage tank is stretched so as to obtain a combustion gas supplying status. If a combustion gas continuously supplying status is desired to be remained, a continue switch provided on a housing is pulled, so a stopping block provided on one end of the continue switch is laterally moved to a location that is on top of a convex sheet of the sliding member, so the sliding member is not able to be recovered to the initial location, the combustion gas continuously supplying status is therefore obtained. The gas discharging valve is that a gas discharging valve gate being connected to a gas adjusting valve seat provide below the gas discharging valve gate, an adjusting button is provided on one lateral end of the gas discharging valve gate and is connected to a Y-shaped positioning member, and the positioning member is exposed outside of the housing, when the adjusting button is operated, the gas discharging valve can supply combustion gas within a preset output range.

In view of the combustion gas control device of the gas combustion apparatus disclosed above, operations of transportation of combustion gas, continuous supply of combustion gas and adjustment of output amount of combustion gas are processed by relative units and have to be individually operated, so operation complexity is increased. In fact, various storage tanks for storing combustion gas or fuel, e.g. a storing device for liquefied gas, are necessary because it can continuously provide combustion material to a combustion device for facilitate the combustion operation.

Due to different zones on the earth, for example zones at higher latitudes, the weather there is colder so the inner storing pressure of gas storing tank is lower, this is a negative factor for the gas and would result in the output amount of combustion gas of the gas discharging valve is not enough, therefore an operation of igniting combustion gas at a combustion section is not able to be smoothly processed. What's more, there are pressure differences between canned gases sold in different zones of the world, so the pressure of filled liquefied gas may be too much or too less. Basically, an output range of combustion gas of a gas discharging valve of a gas combustion apparatus is preset before being shipped out, so the output amount of the gas discharging valve is not able to be reset to accommodate the pressure differences of liquefied gases stored in gas storage tanks. The adjusting button is only capable of adjusting the output amount of the combustion gas of the gas discharging valve within the preset range, and the initial setting of the gas discharging valve is not able to be adjusted.

SUMMARY OF THE INVENTION

The applicant of the present invention has devoted himself to design and commercially distribute gas combustion apparatuses and combustion tools, with a hope to overcome the disadvantages that output amount of combustion gas of a gas discharging valve is not able to be reset for accommodating pressure differences of liquefied gases stored in gas storage tanks, after try and error, the present invention "Gas combustion apparatus and combustion gas setting device thereof" is provided.

One object of the present invention is to provide a gas combustion apparatus having combustion gas setting device, the combustion gas setting device can be served to reset an initial setting of a gas discharging valve for accommodating pressure differences of liquefied gases stored in storage tanks.

Another object of the present invention is to a gas combustion apparatus, and only one step is needed to control the transportation and the continuous supply and the output amount of the combustion gas.

For achieving the objects mentioned above, one solution provided by the present invention is to provide a gas combustion apparatus, comprises: a storage tank, a tank chamber is provided in the storage tank, a hollow tank seat is radially and protrudingly provided on the storage tank, a connecting section provided at the front end of the storage tank is axially provided with a tank opening that communicates with the tank chamber, the tank opening is connected to a gas discharging valve, the gas discharging valve is that a gas discharging valve gate being screw-fitted with a gas adjusting valve seat, and a gas discharging nozzle is axially extended from the gas discharging valve gate; a combustion gas setting device, a connecting hole of a setting unit and a connecting hole of an adjusting unit are respectively connected to the gas discharging valve gate, so after the gas discharging nozzle is passed through the top end of the connecting holes, the gas discharging nozzle is connected to a gas conveying tube, a first resilient member is provided between the adjusting unit and the inside of the housing, and at least one pushing rod is radially and protrudingly provided on the adjusting unit; an ignition device having a sliding member, the rear end of the sliding member is connected to the tank seat and is disposed against a piezoelectric device, the piezoelectric device has a conductive wire extending to a combustion device; a housing composed by two housing members engaging with each other and provided in front of the storage tank for covering the combustion gas setting device, an adjusting slot composed by a vertical and a horizontal slots is provided on the housing with respect to the location where the pushing rod is provided so the pushing rod can be exposed, a key slot is formed at the periphery of the housing and is served to receive the sliding member, a housing tenon is extended from the front end of the housing, the center of the housing tenon has a positioning hole; a combustion device, the combustion device is fastened on the positioning hole via a retaining tube, the rear end of the retaining tube is connected to the gas conveying tube and the front end of the retaining tube is connected to a mixing tube, the front end of the mixing tube is provide with a flame nozzle; and an outer tube, after the outer tube is connected to a connecting ring, the connecting ring is connected to the housing tenon, so the flame nozzle is disposed at the front end of the outer tube; when the pushing rod of the adjusting unit is forwardly pushed from the bottom end of the vertical slot of the adjusting slot and is rotated into the horizontal slot, the first resilient member is compressed and the gas discharging nozzle is stretched by the adjusting unit, and the gas discharging valve gate is rotated in the gas adjusting valve seat, so a combustion gas supplying status is obtained and the output amount of combustion gas can be adjusted; when the pushing rod of the adjusting unit is forwardly pushed to the top end from the bottom end of the vertical slot of the adjusting slot, the first resilient member is compressed and the gas discharging nozzle is stretched by the adjusting unit, so the adjusting unit is released from the gas discharging valve gate, then the setting unit is rotated and the gas discharging valve gate is rotated in the gas adjusting valve seat, therefore the output amount of combustion gas of the gas discharging valve is able to be reset.

Another object of the present invention is to provide a combustion gas setting device capable of resetting initial settings of a gas discharging valve for accommodating pressure difference of liquefied gas stored in a storage tank.

Another solution provided by the present invention is to provide a combustion gas setting device used in a gas combustion apparatus, comprises a storage tank, the front end of the storage tank is provided with a tank opening that communicates with a tank chamber provided inside the storage tank, the tank opening is connected to a gas discharging valve, the gas discharging valve is that a gas discharging valve gate being screw-fitted with a gas adjusting valve seat, and a gas discharging nozzle is axially extended from the gas discharging valve gate; a setting unit, the setting unit is connected to the gas discharging valve gate; an adjusting unit, the adjusting unit is provided adjacent to the setting unit and a connecting hole provided at the bottom end of the adjusting unit is connected to the gas discharging valve gate, so after the gas discharging nozzle is passed through the top end of the connecting hole, the gas discharging nozzle is connected to a gas conveying tube, a first resilient member is provided between the adjusting unit and the inside of the housing, and at least one pushing rod is radially and protrudingly provided on the adjusting unit; and a housing, an adjusting slot composed by a vertical and a horizontal slots is provided on the housing with respect to the location where the pushing rod is provided so the pushing rod can be exposed; when the pushing rod of the adjusting unit is forwardly pushed from the bottom end of the vertical slot of the adjusting slot and is rotated into the horizontal slot, the first resilient member is compressed and the gas discharging nozzle is stretched by the adjusting unit, and the gas discharging valve gate is rotated in the gas adjusting valve seat, so a combustion gas supplying status is obtained and the output amount of combustion gas can be adjusted; when the pushing rod of the adjusting unit is forwardly pushed to the top end from the bottom end of the vertical slot of the adjusting slot, the first resilient member is compressed and the gas discharging nozzle is stretched by the adjusting unit, so the adjusting unit is released from the gas discharging valve gate, then the setting unit is rotated and the gas discharging valve gate is rotated in the gas adjusting valve seat, therefore the output amount of combustion gas of the gas discharging valve is able to be reset.

DETAILED DESCRIPTION OF THE PREFERRED EMBODIMENT

Figure 1:
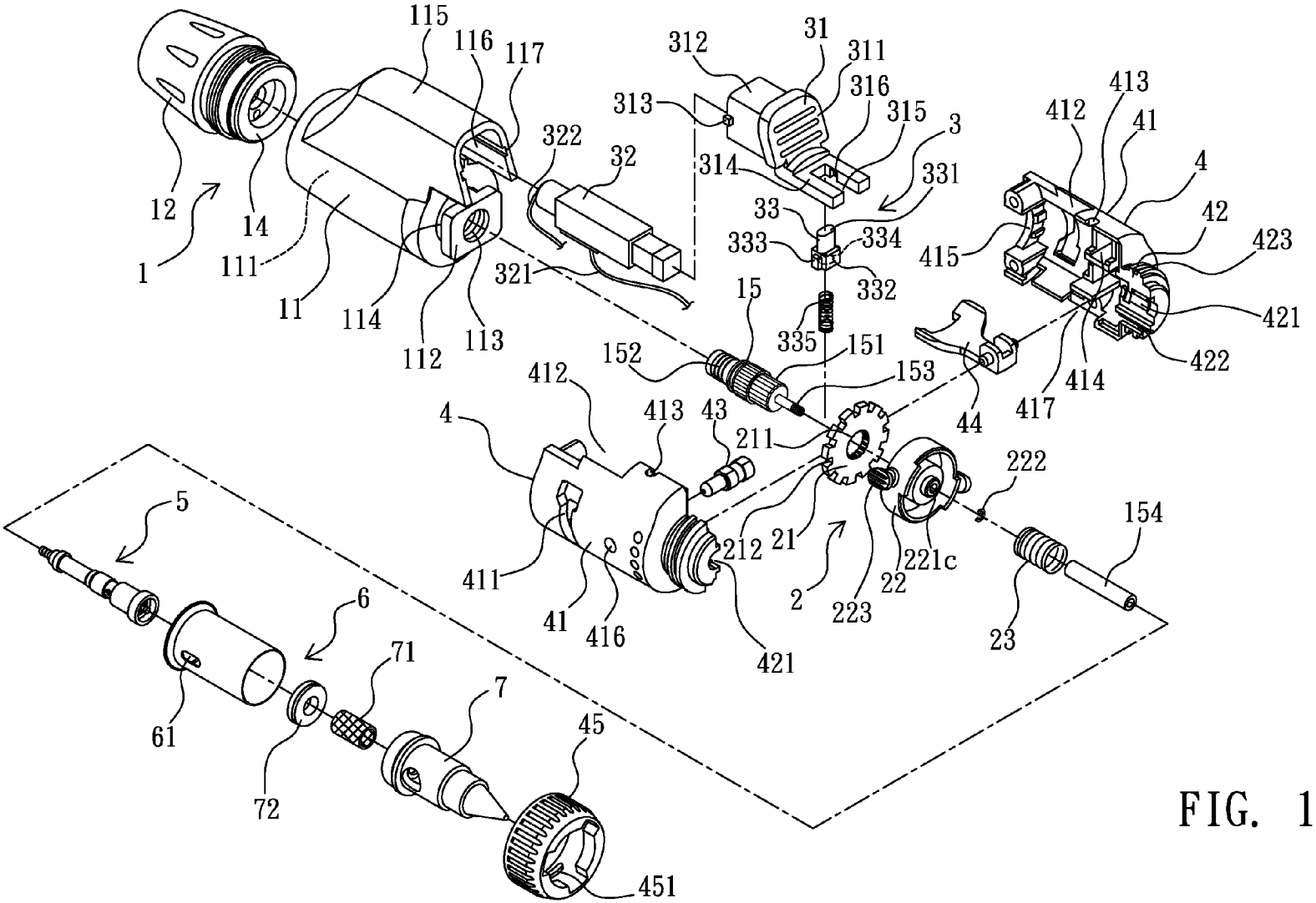
FIG. 1 is a 3D exploded view of the gas combustion apparatus provide by the present invention.

As shown from FIG. 1 to FIG. 7*b*, the gas combustion apparatus provided by the present invention is composed by a storage tank 1, a combustion gas setting device 2, an ignition device 3, a housing 4, a combustion device 5 and an outer tube 6.

Figure 2:
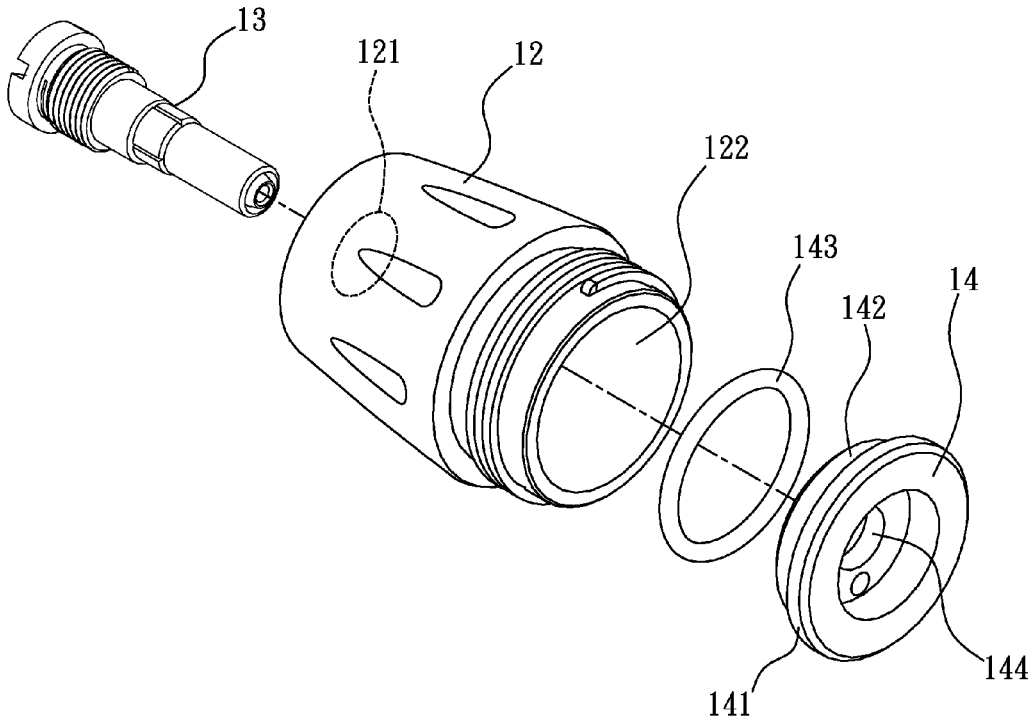
FIG. 2 is a 3D exploded view of the base seat of the storage tank provided by the present invention.

The storage tank 1 is served to store liquefied gas, a bottom end of a tank body 11 is provided with a tank cover 12, the bottom end of the tank cover 12 is connected to a filling valve 13, as shown in FIG. 2, the filling valve 13 is provided in a bottom hole 121 preset on the bottom end of the tank cover 12, the filling valve 13 is served to supply the liquefied gas for combustion. For obtaining a gas sealing status between the tank body 11 and the tank cover 12, an orifice 122 provided on the top end of the tank cover 12 is connected to a step-shaped retaining ring 14, a jointing area defined by a ring sheet 141 and a ring column 142 provided adjacent and below the ring sheet 141 is provided with an O-shaped ring 143, then the ring column 142 is provided in the orifice 122 provided at the top end of the tank cover 12, so the O-shaped ring 143 is clamped by the top end of the tank cover 12 and the ring sheet 141, then the tank cover 12 is connected, e.g. being screwed at the bottom portion of the tank body 11, thus the retaining ring 14 is disposed against an inner wall of a bottom end of a tank chamber 111 provided in the tank body 11 and the retaining ring 14 is therefore positioned. When the tank cover 12 is rotated, the O-shaped ring 143 is gradually tightened so as to obtain the gas sealing status. The liquefied combustion material, e.g. gas, filled in the tank cover 12 passes through plural through holes 144 preset on the ring column 142 to enter and store in the tank chamber 111.

A connecting section 112 provided at the top end of the tank body 11 is axially provided with a tank opening 113 that communicates with the tank chamber 111 for accommodating and positioning a gas discharging valve 15. A concave neck section 114 is defined between the connecting section 112 and the tank body 11 and is served to connect to the housing 4. A tank seat 115 is radially and protrudingly provided on the tank body 11 and an accommodating chamber 116 is defined within the tank seat 115, inner walls of the tank seat 115 that oppositely provided are respectively provided with a jointing section 117, e.g. a sliding slot, for accommodating and positioning the ignition device 3.

As shown in FIG. 1, the gas discharging valve 15 is a conventional gas discharging valve and is fastened on the tank opening 113, the gas discharging valve 15 is that a gas discharging valve gate 151 screwed with a gas adjusting valve seat 152, and the gas adjusting valve seat 152 is fastened on the tank opening 113 and a gas discharging nozzle 153 is axially provided on the gas discharging valve gate 151, the gas discharging nozzle 153 is connected to a gas conveying tube 154, e.g. a soft tube, so combustion gas can be conveyed to the combustion device 5. When the gas discharging nozzle 153 is stretched, the combustion gas stored in the storage tank 1 is able to be supplied, and when retracted, the combustion gas supply is terminated.

The combustion gas setting device 2 is composed by a setting unit 21, an adjusting unit 22 and a first resilient member 23, a central axial hole 211 of the setting unit 21 is connected to the gas discharging valve gate 151, and the periphery of the setting unit 21 is provided with plural pulling slots 212. A connecting hole 221 is axially provided on the adjusting unit 22 and is also connected to the gas discharging valve gate 151. From top to bottom, the connecting hole 221 is in sequence and protrudingly provided with a connecting section 221*a*, e.g. plural convex teeth, and a releasing section 221*b*, the convex teeth of the connecting section 221*a* are engaged with concave slots of the gas discharging valve gate 151, so that after the gas discharging nozzle 153 is passed through a nozzle hole 221*c* provided on the top end of the connecting hole 221, the gas discharging nozzle 153 is connected to a connecting member 222, e.g. a buckling ring. When the adjusting unit 22 is axially moved, a releasing status is defined by the gas discharging valve gate 151 and the releasing section 221*b* or an engaging status is defined when the gas discharging valve gate 151 is engaged with the connecting section 221*a*, so the gas discharging nozzle 153 is stretched for supplying gas or is retracted for terminating gas supply.

In order to provided an automatic recovery function to the adjusting unit 22 after the adjusting unit 22 is axially moved, the first resilient member 23, e.g. a spring, is provided between the adjusting unit 22 and the housing 4, and the inside of the resilient member 23 can allow the gas discharging nozzle 153 and the gas conveying tube 154 pass through so the gas transportation is not interfered. And at least one pushing rod 223 is radially and protrudingly provided on the adjusting unit 22, a pair of pushing rods 223 that oppositely protrude are preferably provided, so the pushing rods 223 are able to be exposed via adjusting slots 411 of the housing 4 for operations of axial movements and rotations.

The ignition device 3 includes a sliding member 31, a piezoelectric device 32 and a latching member 33. A frame-shaped member 312 is extruded from a rear end of a pressing sheet 311 of the sliding member 31, the frame-shaped member 312 is connected to the accommodating chamber 116 formed in the tank seat 115 and is provided against the piezoelectric device 32, so after the sliding member 31 is released, the sliding member 31 can be automatically recovered and a locking status is automatically defined. For having a smooth sliding effect, positioning sections 313, e.g. sliding tenons, are provided on the frame-shaped member 312 with respect to the location where the jointing sections 117, e.g. sliding slots, are provided, so when engaged, the sliding member 31 can smoothly slide in the accommodating chamber 116 for pressing the piezoelectric device 32. The front end of the pressing sheet 311 is provided with two parallel rack sheets 314 and a guiding slot 315 is defined between the two rack sheets 314, so the latching member 33 can be accommodated or can be longitudinally moved. Two buckling slots 316 defined as a pair are respectively, concavely and longitudinally provided on the two rack sheets 314, so operations of locking or releasing the latching member 33 can be defined with respect to the buckling slots 316.

The piezoelectric device 32 is a conventional piezoelectric device and is provided in the accommodating chamber 116 formed in the tank seat 115, and the piezoelectric device 32 can be pressed by the sliding member 31 so a conductive wire 321 thereof is extended to the combustion device 5 for igniting the mixed combustion gas.

The latching member 33 is a reverse-T shaped key member, a pressing button 331 is protrudingly provided on the top end of the latching member 33, a buckling tenon 333 is respectively and horizontally extended from a left and a right sides of a stopping block 332 provided at the bottom of the latching member 33, and a second resilient member 335, e.g. a spring, is provided in a concave hole 334 provided at the bottom end of the stopping block 332. As shown in FIG. 1, FIG. 4 to FIG. 7*b*, the pressing button 331 of the latching member 33 is received in the guiding slot 315, and the two buckling tenons 333 are buckled in the buckling slots 316 so as to obtain a locking status, and the second resilient member 335 is provided across a rack slot 414 of the housing 4. When the pressing button 331 is pressed, the second resilient member 335 is compressed so the buckling tenons 333 are released from the buckling slots 316, the locking status is therefore released, then the sliding member 31 is able to be backwardly pressed to press the piezoelectric device 32, a high voltage static electricity is generated is generated by the piezoelectric device 32 and is conveyed by the conductive wire 321, and after an ignition operation is processed on the combustion device 5, the sliding member 31 is immediately released and the sliding member 31 is forwardly moved due to the released energy generated by the piezoelectric device 32, and when the sliding member 31 is moved to the latching member 33, the buckling tenons 333 are automatically buckled in the buckling slots 316, so a locking status is automatically obtained.

The housing 4 is mainly composed by two cover members 41 engaging with each other, and is disposed in front of the storage tank 1, a T-shaped adjusting slot 411 is respectively provided on the two cover members 41 with respect to the locations where the pushing rods 223 of the adjusting unit 22 are provided, e.g. a horizontal slot being communicated with one lateral side of a vertical slot, so each of the pushing rods 223 can be installed in the corresponding adjusting slot 411 and be exposed outside of the housing 4. The top end of the housing 4 is respectively provided with a key slot 412 and a button hole 413 for respectively accommodating the rack sheets 314 of the sliding member 31 and for allowing the pressing button 331 of the latching member 33 to be exposed. A rack slot 414 is provided inside the housing 4 and below the button hole 413 for accommodating the second resilient member 335. A pair of neck sheets 415 are extended from the rear portion of the housing 4 so the concave neck section 114 of the storage tank 1 can be mounted therein. A housing tenon 42 is extended from the front portion of the housing 4, the central and the lateral sides of the housing tenon 42 are respectively provided with a positioning hole 421 and a slit hole 422, so the combustion device 5 and a guiding wire 322 can be accommodated and positioned, and a housing thread 423 is provided on the surface of the housing tenon 42 for being connected with combustion tools.

The housing 4 is further provided with a step-shaped gas supply suspending button 43 which is extended from a button hole 416 preset on the housing 4. When the gas supply suspending button 43 is pressed, the bottom end thereof presses the gas conveying tube 154 and the gas conveying tube 154 is therefore flatten to stop the combustion gas supply. A flame on the combustion device 5 is snuffed out due to the described operation, then the gas supply suspending button 43 is released and is recovered due to the elasticity of the gas conveying tube 154, thus the combustion gas can continue pass through the gas conveying tube 154 and the combustion device 5, and the combustion gas is able to be supplied to a heating member 71 provided inside a soldering iron head 7 so as to obtain a smoldering status. A Y-shaped supporting rack 44 is pivotally connected to a rack slot 417 concavely provided at the bottom end of the housing 4. When the gas combustion apparatus is not in use, the supporting rack 44 can be forwardly rotated to open for supporting the gas combustion apparatus.

Figure 3:
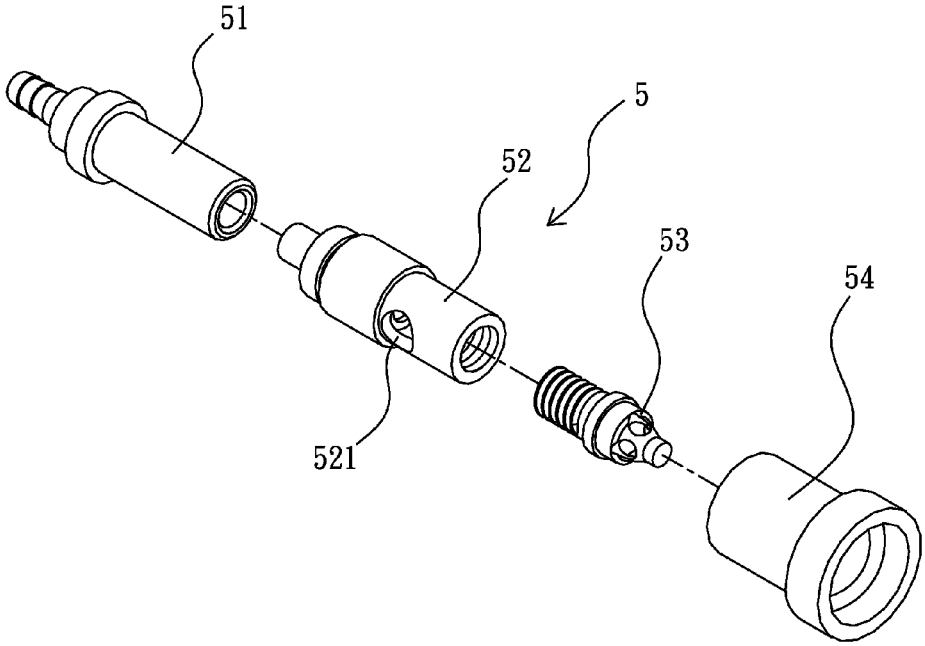
FIG. 3 is a 3D exploded view of the combustion device provided by the present invention.
Figure 4:
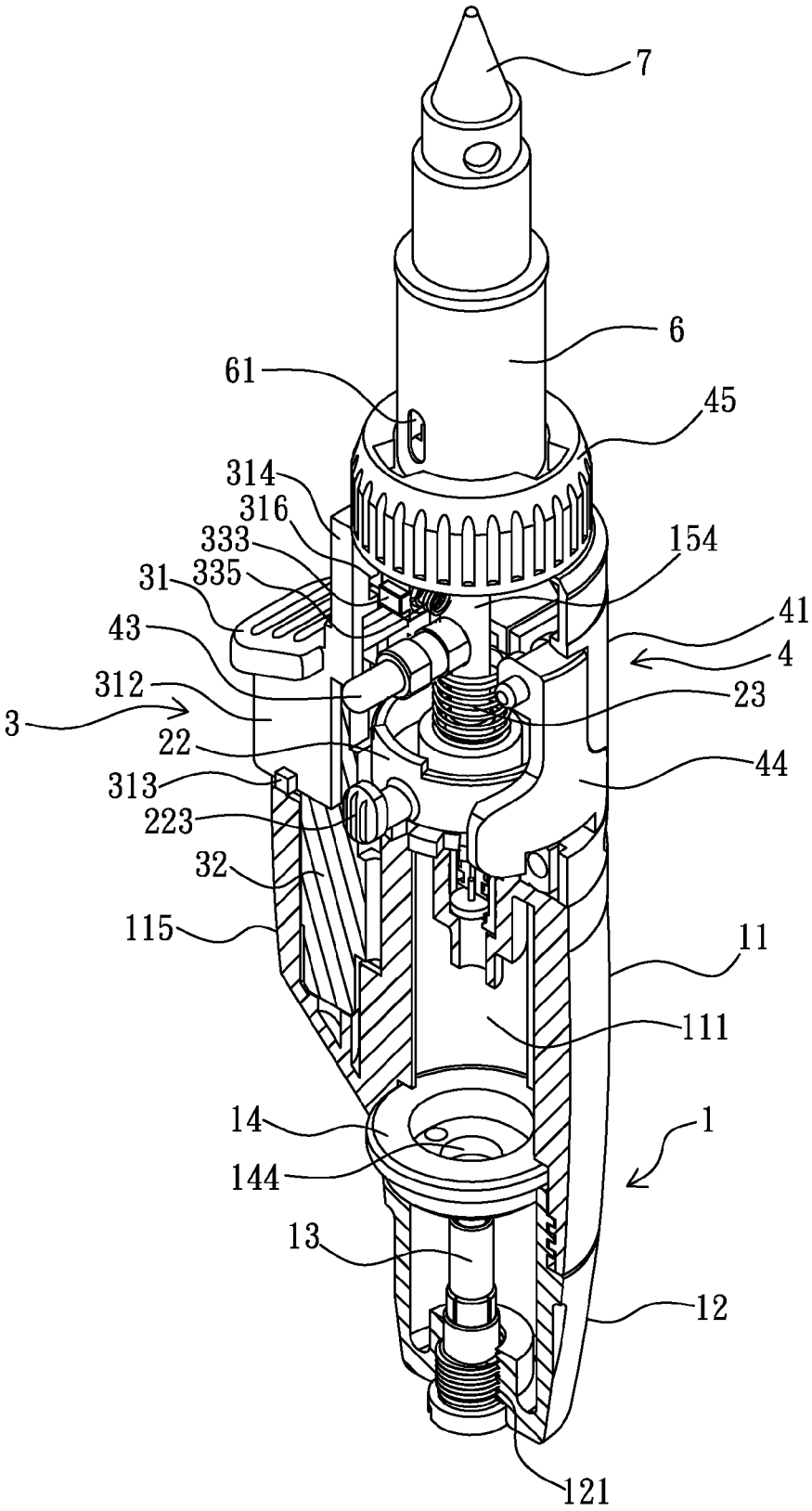
FIG. 4 is a 3D cross sectional view of the storage tank after being assembled.
Figure 5:
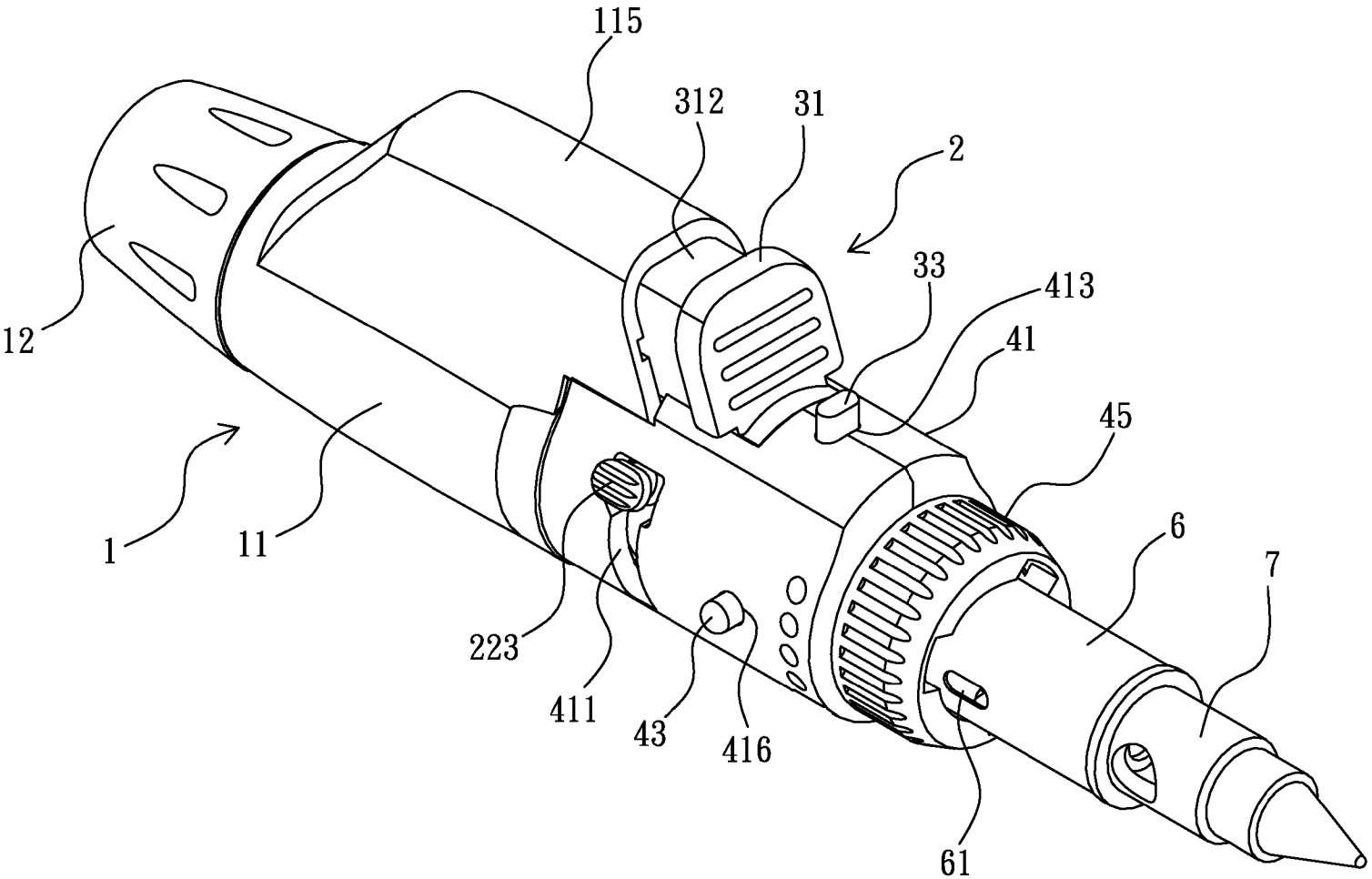
FIG. 5 is a 3D view of the gas combustion apparatus provided by the present invention after being assembled.

As shown in FIG. 3, a rear end of a retaining tube 51 fastened on the positioning hole 421 is connected to the gas conveying tube 154 and a front end of the retaining tube 51 is connected to a mixing tube 52, at least one gas introducing hole 521 is provided on the mixing tube 52, when vaporized combustion gas passes through the mixing tube 52, an air flow is generated and external air is introduced via the gas introducing hole 521, so the introduced air enters the mixing tube 52 and is processed with a mixing operation to facilitate the combustion. The mixed combustion gas is jetted via a flame nozzle 53 connected to the front end of the mixing tube 52. For obtaining a better thermal insulation efficiency, a thermal insulating ring 54 made of ceramic is provided at an outer side of the flame nozzle 53.

Figure 6:
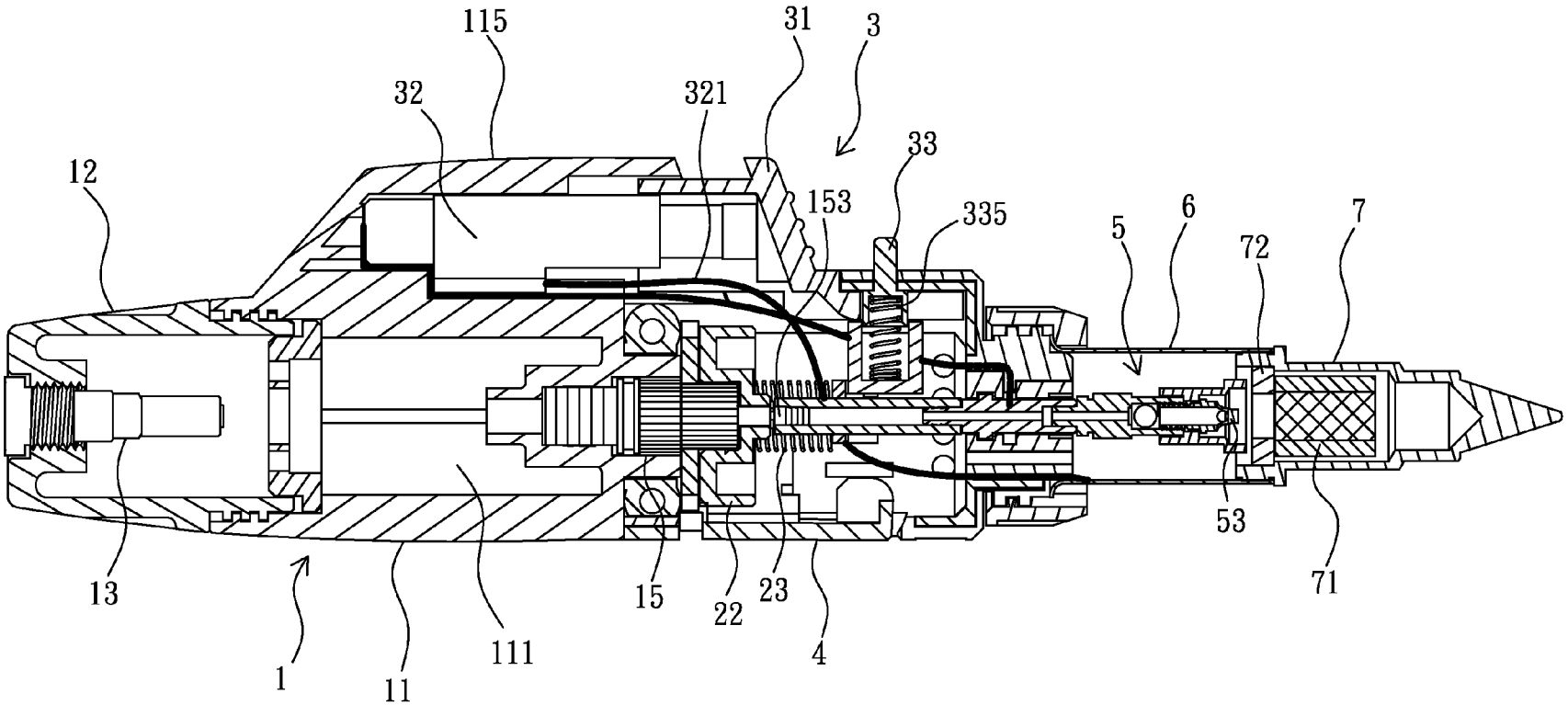
FIG. 6 is a cross sectional view of the gas combustion apparatus provided by the present invention after being assembled.

To utilize the present invention as a gas combustion apparatus, the outer tube 6 is connected to a connecting ring 45, then a connecting operation is processed on the connecting ring 45, for example an inner thread 451 of the connecting ring 45 is screwed-fitted with the housing thread 423 of the housing tenon 42, so the flame nozzle 53 is disposed on the front end of the outer tube 6. An air venting slot 61 is provided on the outer tube 6 with respect to the location where the air introducing hole 521 is provided to facilitate the air introducing operation; after the latching member 33 is pressed to release the locking status, the sliding member 31 is pressed to compress the piezoelectric device 32 so the conductive wire 321 is in contact with the retaining tube 51, high voltage static electricity is passed through the mixing tube 52 and is transferred via the flame nozzle 53, thus a spark is generated between the flame nozzle 53 and the outer tube 6 to ignite the mixed combustion gas jetted by the flame nozzle 53, so a gas combustion apparatus is obtained. As shown in FIG. 6. a guiding wire 322 is provided in the slit hole 422 for being in contact with the outer tube 6, the guiding wire 322 is extended to the piezoelectricity device 32 so as to obtain a circuit.

Figure 7A:
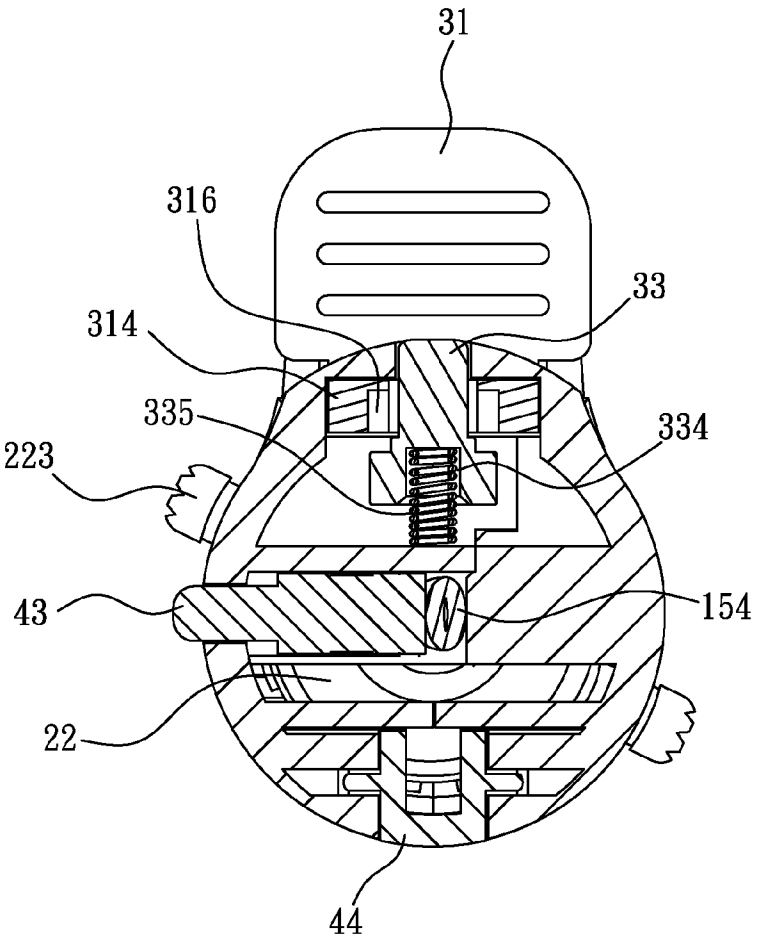
FIG. 7*a* is a cross sectional view of the latching member and the gas supply suspending button in a non-operated status.
Figure 7B:
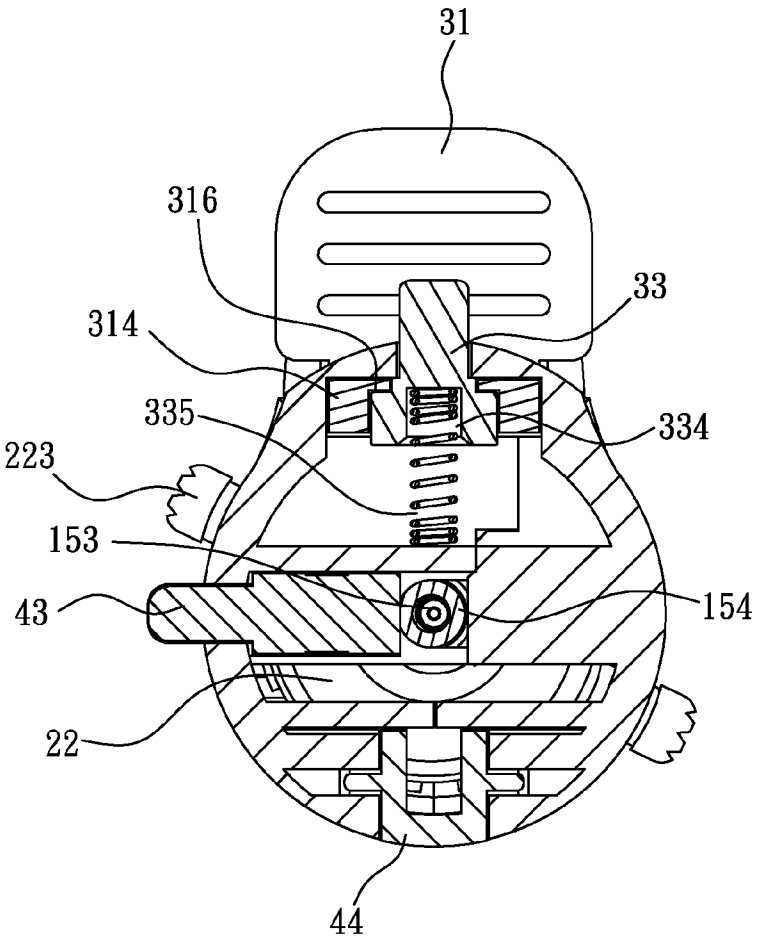
FIG. 7*b* is a cross sectional view of the latching member and the gas supply suspending button in an operated status.
Figure 8:
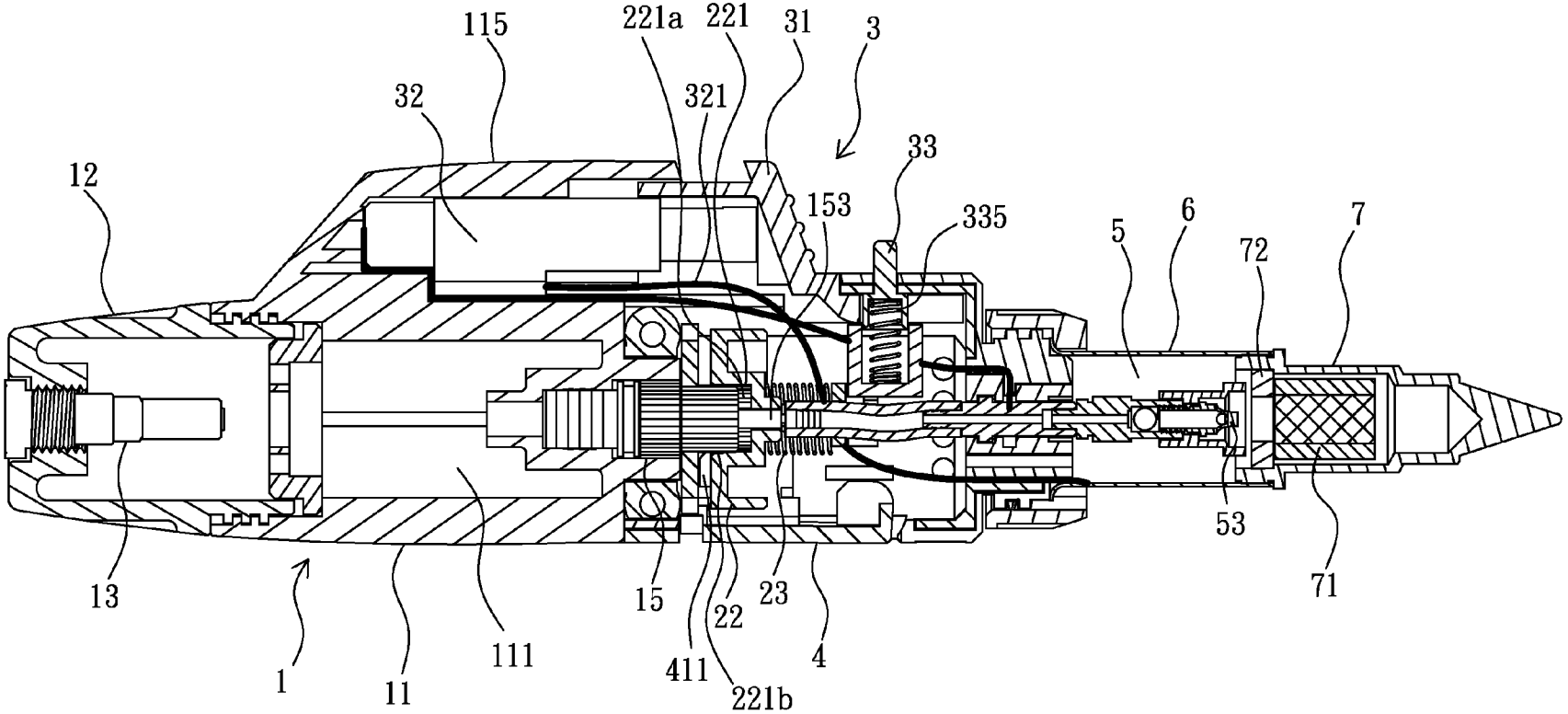
FIG. 8 is a cross sectional view of the combustion gas setting device while combustion gas is continuously supplied.
Figure 9:
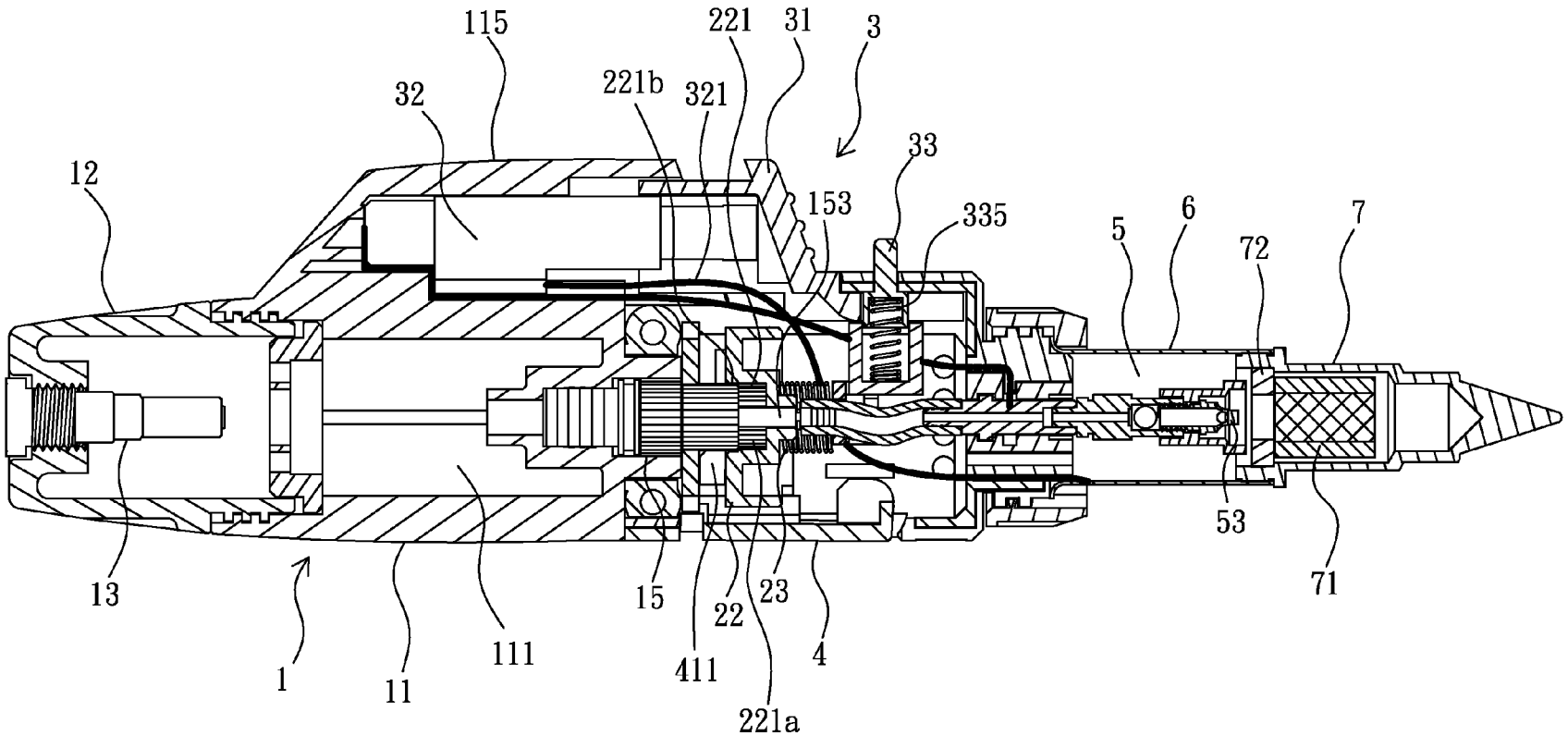
FIG. 9 is a cross sectional view of the combustion gas setting device while the initial value of the gas discharging valve is reset.

The front end of the outer tube 6 can be provided with a soldering iron head 7, the inside of the soldering iron head 7 has a heating member 71 and a retaining ring 72, so the combustion flame can be served to heat and burn the heating member 71, as shown in FIG. 7*a*, the gas conveying tube 154 is not pressed by the gas supply suspending button 43, so the combustion gas can be continuously supplied to the combustion device 5, and when the flame nozzle 53 is ignited, the generated flame can be served to heat and burn the heating member 71; as shown in FIG. 7*b*, when the gas supply suspending button 43 is pressed, the gas conveying tube 154 is flatten for terminating the combustion gas supply, the flame of the flame nozzle 53 is therefore snuffed out, then the gas supply suspending button 43 is released, so the combustion gas can be continued to pass through the gas conveying tube 154 and the combustion device 5, and the combustion gas can be supplied to the heating member 71 which is in a flaming status and a smoldering status is obtained and a gas soldering iron is obtained.

Referring to FIG. 1, FIG. 4 to FIG. 6 and FIG. 8, when the gas combustion apparatus provided by the present invention is desired to be operated, the pushing rods 223 of the adjusting unit 22 are upwardly pushed along the vertical slot of the T-shaped adjusting slot 411 of the housing 4 to compress the first resilient member 23, because of the upward movement of the adjusting unit 22, the gas discharging nozzle 153 of the gas discharging valve 15 is stretched, so a combustion gas supplying status is obtained, then the adjusting unit 22 is rotated in the horizontal slot of the adjusting slot 411 to adjust the output amount of the combustion gas. When a user presses the latching member 33 and the latching member 33 is moved to compress the second resilient member 335, the buckling tenons 333 are released from the buckling slots 316 of the sliding member 31 so the locking status is released, then the sliding member 31 is pressed to press the piezoelectric device 32 provided in the tank seat 115, so a high voltage static electricity is generated, the generated high voltage static electricity passes through the conductive wire 321 and the combustion device 5, so a spark is generated between the retaining ring 72 and the flame nozzle 53, the flame nozzle 53 is therefore ignited to heat and burn the heating member 71 provided inside the soldering iron head 7. The gas supply suspending button 43 is pressed to snuff off the flame, then the gas supply suspending button 43 is released so the combustion gas is continuously supplied to the heating member 71 for processing a welding operation. When the operation is desired to be stopped, the adjusting unit 22 received in the horizontal slot is reversely moved and when the adjusting unit 22 is moved to the vertical slot, energy is released by the first resilient member 23, and due to the generated energy the adjusting unit 22 is pushed to the bottom end of the vertical slot and the gas discharging nozzle 153 is retracted, the combustion gas supply is therefore terminated.

Referring to FIG. 1, FIG. 4 to FIG. 6 and FIG. 9, if the output amount of the combustion gas of the gas discharging valve 15 is desired to be reset, the pushing rods 223 of the adjusting unit 22 are upwardly pushed to the top end of the vertical slot of the T-shaped adjusting slot 411 of the housing 4, the first resilient member 23 is therefore compressed and the connecting section 221*a* provided in the connecting hole 221 of the adjusting unit 22 is upwardly moved, so the releasing section 221*b* is not engaged with the gas discharging valve gate 151, a linking relationship is therefore released. The gas discharging nozzle 153 of the gas discharging valve 15 is stretched due to the upward movement of the adjusting unit 22, a combustion gas supplying status is obtained. At least one tool is inserted into the adjusting slot 411 and the pulling slot 212 of the setting unit 21 is pulled so the gas discharging valve gate 151 is able to be rotated in the gas adjusting valve seat 152, the output amount of the combustion gas of the gas discharging valve 15 is therefore reset. When the setting operation is finished, the adjusting unit 22 is released so energy is released by the first resilient member 23, the adjusting unit 22 is pushed to the bottom end of the vertical slot, the connecting section 221*a* provided in the connecting hole 221 is again connected to the gas discharging valve gate 151 due to the downward movement of the adjusting unit 22, and the gas discharging nozzle 153 is retracted, the combustion gas supply is therefore terminated.

The features of the present invention is that the adjusting unit of the combustion gas setting device is not only able to control the transportation and the output amount of the combustion gas, but also to reset the output amount of the combustion gas of the gas discharging valve via adjusting the setting unit, so the pressure differences inside the storage tank due to different zones can be accommodated; and only one step is needed for the adjusting unit to directly control the transportation and the continuous supply and preset output amount of the combustion gas; the gas combustion apparatus provided by the present invention is small in volume and easy to carry around; according to actual needs, the gas combustion apparatus provided by the present invention can adopt combustion tools, e.g. a combustion device or a gas soldering iron; a manual unlocking and an automatic locking functions are provided between the ignition device and the housing so children can be prevented from accidentally using; and by providing a gas supply suspending button, the combustion gas supply can be temporally terminated, so after the flame of the combustion device is snuffed out, the combustion gas can still be supplied to the heating member provided inside the soldering iron head.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gas combustion apparatus, comprises:

a storage tank, a tank chamber is provided in the storage tank, a hollow tank seat is radially and protrudingly provided on the storage tank, a connecting section provided at the front end of the storage tank is axially provided with a tank opening that communicates with the tank chamber, the tank opening is connected to a gas discharging valve, the gas discharging valve is that a gas discharging valve gate being screw-fitted with a gas adjusting valve seat, and a gas discharging nozzle is axially extended from the gas discharging valve gate;

a combustion gas setting device, connecting holes of a setting unit and an adjusting unit provided adjacent to the setting unit are respectively connected to the gas discharging valve gate, so after the gas discharging nozzle is passed through the top ends of the connecting holes, the gas discharging nozzle is connected to a gas conveying tube, a first resilient member is provided between the adjusting unit and the inside of the housing, and at least one pushing rod is radially and protrudingly provided on the adjusting unit;

an ignition device having a sliding member, the rear end of the sliding member is connected to the tank seat and is disposed against a piezoelectric device, the piezoelectric device has a conductive wire extending to a combustion device;

a housing composed by two housing members engaging with each other and provided in front of the storage tank for covering the combustion gas setting device, an adjusting slot composed by a vertical and a horizontal slots is provided on the housing with respect to the location where the pushing rod is provided so the pushing rod can be exposed, a key slot is formed at the periphery of the housing and is served to receive the sliding member, a housing tenon is extended from the front end of the housing, the center of the housing tenon has a positioning hole;

the combustion device is fastened on the positioning hole via a retaining tube, the rear end of the retaining tube is connected to the gas conveying tube and the front end of the retaining tube is connected to a mixing tube, the front end of the mixing tube is provide with a flame nozzle; and an outer tube, after the outer tube is connected to a connecting ring, the connecting ring is connected to the housing tenon, so the flame nozzle is disposed at the front end of the outer tube;

when the pushing rod of the adjusting unit is forwardly pushed from the bottom end of the vertical slot of the adjusting slot and is rotated into the horizontal slot, the first resilient member is compressed and the gas discharging nozzle is stretched by the adjusting unit, and the gas discharging valve gate is rotated in the gas adjusting valve seat, so a combustion gas supplying status is obtained and the output amount of combustion gas can be adjusted; when the pushing rod of the adjusting unit is forwardly pushed to the top end from the bottom end of the vertical slot of the adjusting slot, the first resilient member is compressed and the gas discharging nozzle is stretched by the adjusting unit, so the adjusting unit is released from the gas discharging valve gate, then the setting unit is rotated and the gas discharging valve gate is rotated in the gas adjusting valve seat, therefore the output amount of combustion gas of the gas discharging valve is able to be reset.

2. The gas combustion apparatus as claimed in claim 1, wherein plural pulling slots are provided at the periphery of the setting unit.

3. The gas combustion apparatus as claimed in claim 1, wherein from top to bottom, the connecting hole of the adjusting unit is in sequence and protrudingly provided with a connecting section and a releasing section; due to a vertical movement of the adjusting unit, the connecting section and the gas discharging valve gate are engaged so as to obtain a linking status, or the releasing section and the gas discharging valve gate are not engaged so as to obtain a releasing status; after the gas discharging nozzle is passed through a nozzle hole provided on the top end of the connecting hole, the gas discharging nozzle is connected to a connecting member.

4. The gas combustion apparatus as claimed in claim 1, wherein the gas combustion apparatus is further provided with a soldering iron head connected to the front end of the outer tube, the inside of the soldering iron head has a heating member and a retaining ring.

5. The gas combustion apparatus as claimed in claim 1, wherein the gas combustion apparatus is further provided with a gas supply suspending button, the top end thereof is protrudingly provided in a button hole preset on the housing, the bottom end thereof is provided adjacent to the gas conveying tube, when the gas supply suspending button is pressed, the gas conveying tube is pressed so that the combustion gas supply is terminated.

6. The gas combustion apparatus as claimed in claim 1, wherein the storage tank is composed by a tank body and a tank cover, the bottom end of the tank cover is connected to a filling valve, an orifice provided on the top end of the tank cover is connected to a retaining ring, a jointing area defined by a ring sheet and a ring column provided below the ring sheet is provided with an O-shaped ring, then the ring column having plural through holes is provided in the orifice provided at the top end of the tank cover, the tank cover is provided at the bottom end of the tank body, so the retaining ring is provided against inner walls of the bottom end of the tank chamber, the O-shaped ring is therefore tightened.

7. The gas combustion apparatus as claimed in claim 1, wherein a supporting rack is pivotally connected to a rack slot concavely provided at the bottom end of the housing, the supporting rack can be forwardly rotated to open for supporting the gas combustion apparatus.

8. The gas combustion apparatus as claimed in claim 1, wherein a concave neck section is provided between the tank body and the connecting section, so two neck sheets correspondingly provided and extended from the rear end of the housing can be mounted and connected with the neck section.

9. The gas combustion apparatus as claimed in claim 1, wherein a frame-shaped section is protrudingly provided at the rear end of the sliding member, the frame-shaped section is provided in the tank chamber provided inside the tank seat, two opposite lateral walls of the tank chamber are respectively provided with a jointing section and two opposite walls of the frame-shaped member are respectively provided with a positioning section with respect to the location where each of the jointing sections is provided, so the sliding member can slide in the tank chamber.

10. The gas combustion apparatus as claimed in claim 1, wherein the ignition device further includes:

a latching member, a pressing button is protrudingly provided on the top end of the latching member and the pressing button is passed through the button hole of the housing, a buckling tenon is respectively and horizontally extended from a left and a right sides of a stopping block provided at the bottom of the latching member, and a second resilient member is provided in a concave hole provided at the bottom end of the stopping block, the second resilient member is provided in a rack slot provided inside the housing;

two parallel rack sheets are extended from the front end of the sliding member and a guiding slot is defined between the two rack sheets so the pressing button can be exposed, and two buckling slots defined as a pair are respectively, concavely and longitudinally provided on the two rack sheets, the buckling slots are served to buckle the buckling tenons so a locking status is obtained on the sliding member; when the pressing button is pressed, the second resilient member is compressed and the buckling tenons are released from the buckling slots, so the locking status formed on the sliding member is released and the sliding member is able to be backwardly pressed.

11. The gas combustion apparatus as claimed in claim 1, wherein a thermal insulating ring made of ceramic is provided at an outer side of the flame nozzle.

12. The gas combustion apparatus as claimed in claim 1, wherein at least one air introducing hole is provided on the mixing tube and an air venting slot is provided on the outer tube with respect to the location where the air introducing hole is provided.

13. The gas combustion apparatus as claimed in claim 1, wherein the retaining tube of the combustion device is in contact with the conductive wire in the positioning hole of the housing tenon, and a slit hole is further provided on the housing tenon, a guiding wire is provided in the slit hole, one end of the guiding wire is in contact with the outer tube and the other end thereof is connected to the piezoelectric device.

14. A combustion gas setting device used in a gas combustion apparatus, comprises:

a storage tank, the front end of the storage tank is provided with a tank opening that communicates with a tank chamber provided inside the storage tank, the tank opening is connected to a gas discharging valve, the gas discharging valve is that a gas discharging valve gate being screw-fitted with a gas adjusting valve seat, and a gas discharging nozzle is axially extended from the gas discharging valve gate;

a setting unit, the setting unit is connected to the gas discharging valve gate;

an adjusting unit, the adjusting unit is provided adjacent to the setting unit and a connecting hole provided at the bottom end of the adjusting unit is connected to the gas discharging valve gate, so after the gas discharging nozzle is passed through the top end of the connecting hole, the gas discharging nozzle is connected to a gas conveying tube, a first resilient member is provided between the adjusting unit and the inside of a housing, and at least one pushing rod is radially and protrudingly provided on the adjusting unit; and the housing, an adjusting slot composed by a vertical and a horizontal slots is provided on the housing with respect to the location where the pushing rod is provided so the pushing rod can be exposed;

when the pushing rod of the adjusting unit is forwardly pushed from the bottom end of the vertical slot of the adjusting slot and is rotated into the horizontal slot, the first resilient member is compressed and the gas discharging nozzle is stretched by the adjusting unit, and the gas discharging valve gate is rotated in the gas adjusting valve seat, so a combustion gas supplying status is obtained and the output amount of combustion gas can be adjusted; when the pushing rod of the adjusting unit is forwardly pushed to the top end from the bottom end of the vertical slot of the adjusting slot, the first resilient member is compressed and the gas discharging nozzle is stretched by the adjusting unit, so the adjusting unit is released from the gas discharging valve gate, then the setting unit is rotated and the gas discharging valve gate is rotated in the gas adjusting valve seat, therefore the output amount of combustion gas of the gas discharging valve is able to be reset.

15. The combustion gas setting device used in the gas combustion apparatus as claimed in claim 14, wherein plural pulling slots are provided at the periphery of the setting unit.

16. The combustion gas setting device used in the gas combustion apparatus as claimed in claim 14, wherein from top to bottom, the connecting hole of the adjusting unit is in sequence and protrudingly provided with a connecting section and a releasing section; due to a vertical movement of the adjusting unit, the connecting section and the gas discharging valve gate are engaged so as to obtain a linking status, or the releasing section and the gas discharging valve gate are not engaged so as to obtain a releasing status.

17. The combustion gas setting device used in the gas combustion apparatus as claimed in claim 14, wherein after the gas discharging nozzle is passed through a nozzle hole provided on the top end of the connecting hole of the adjusting unit, the gas discharging nozzle is connected to a connecting member so the gas discharging nozzle is able to be connected to the adjusting unit.

* * * * *